US006684804B2

(12) United States Patent
Gustafsson et al.

(10) Patent No.: US 6,684,804 B2
(45) Date of Patent: Feb. 3, 2004

(54) RUDDER CONSTRUCTION

(75) Inventors: Esa Gustafsson, Kotka (FI); Erkki Karvinen, Helsinki (FI); Juba Karvinen, Siltakyla (FR); Jorma Salonen, Kerava (FI)

(73) Assignee: Kajak-Sport Oy (FI)

( * ) Notice: Subject to any disclaimer, the term of this patent is extended or adjusted under 35 U.S.C. 154(b) by 0 days.

(21) Appl. No.: 10/164,834

(22) Filed: Jun. 7, 2002

(65) Prior Publication Data

US 2002/0185047 A1 Dec. 12, 2002

(51) Int. Cl.[7] ..... B63H 25/06
(52) U.S. Cl. ..... 114/162; 441/79
(58) Field of Search ..... 114/140, 162, 114/172; 441/79

(56) References Cited

U.S. PATENT DOCUMENTS 319,665 A * 6/1885 Barney ..... 114/162
594,068 A * 11/1897 Dobson ..... 114/162
3,670,685 A * 6/1972 Milessa ..... 114/162
4,556,006 A * 12/1985 Kaupat ..... 114/162
4,733,496 A * 3/1988 Wallner ..... 441/79
5,273,472 A * 12/1993 Skedeleski et al. ..... 441/79
5,367,970 A * 11/1994 Beauchamp et al. ..... 114/140
5,480,331 A * 1/1996 Lewis ..... 441/79
5,807,152 A * 9/1998 Wojcik ..... 441/79

* cited by examiner

*Primary Examiner*—S. Joseph Morano
*Assistant Examiner*—Lars A. Olson
(74) *Attorney, Agent, or Firm*—Skinner and Associates

(57) ABSTRACT

A rudder construction for use particularly in light vessels, for example, in kayaks, and including a rudder blade (1) attached permanently to the hull (11) of the vessel and equipped with a thinned zone (9) to allow the main part of the rudder blade to turn, as well as with at least one flexible zone (17) to create flexibility in at least part of the rudder construction in a collision. The rudder construction is manufactured essentially entirely from an elastomeric material. The flexible zone (17) is formed from a weakening in the material thickness of the rudder construction and permits at least part of the rudder blade (1) to bend to the side.

8 Claims, 4 Drawing Sheets

B–B c – c

RUDDER CONSTRUCTION

BACKGROUND OF THE INVENTION

The present invention relates to a rudder construction and particularly to a flexible rudder construction, with the aid of which it is possible to prevent the rudder from breaking, for example, if it is water that is too shallow, or the rudder strikes a stone.

Rudders are generally used to steer small water craft, for example, kayaks. According to the state of the art, products are known, in which a rudder blade made from a rigid material is pivoted and attached to the vessel through a rigid attachment. This is a general principle in all vessels, from ocean-going ships to kayaks. The technology presently used also works, as such, in small vessels, though its durability is not adequate in all conditions.

Kayaks are also used to travel in shallow water, in which case the rudder blade is liable to strike the bottom. On shore, the vessel is usually moved by manpower, when, if the carrier's grip slips, the vessel will drop onto the ground and the rudder may be damaged. Although, in existing solutions, the blade is pivoted so that it can fold in a backwards and forwards direction, none of the solutions permit the blade to bend sideways. The blade is often bent sideways, if the vessel drops from its carrier's grip.

If a rudder according to an existing solution is made, for example, from steel, so that it will withstand rough handling, the rigid attachment/pivoting solution transmits forces into the hull of the vessel, which is of thin plastic. The hull will then generally be in danger of being damaged. Existing solutions require several components, leading to high manufacturing costs and relatively complicated constructions.

The present invention is intended to eliminate the defects of the state of the art described above and create an unbreakable and simple rudder constructions that operates well.

The above and other benefits and advantages of the invention are achieved in manner stated to be characteristic in the accompanying claims.

BRIEF SUMMARY OF THE INVENTION

In brief, this invention is based on an entirely new innovation, in which the entire rudder construction is made from an unbreakably elastic material with excellent elastic properties. An example of one such material is elastomeric polyurethane. In addition, in the solution according to the invention, the entire product can be manufactured in a mould while in the best case only a single component is required.

BRIEF DESCRIPTION OF THE SEVERAL VIEWS OF THE DRAWING

In the following, the invention is examined in greater detail with reference to the accompanying drawings, in which.

DETAILED DESCRIPTION

Figure 1:
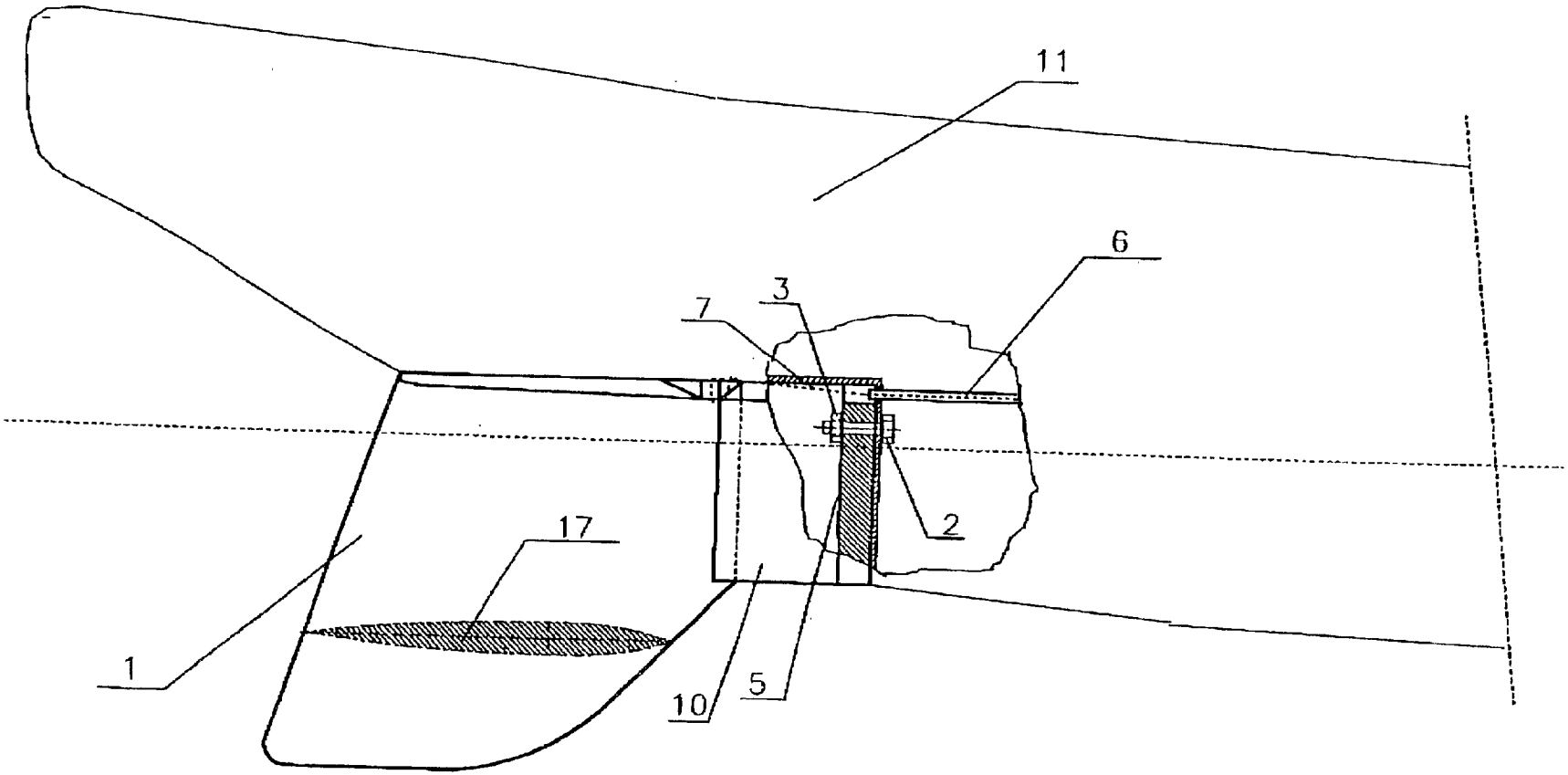
FIG. 1 shows a side view and partial cut-away view of a rudder according to the invention, installed in the stern of a kayak.
Figure 2:
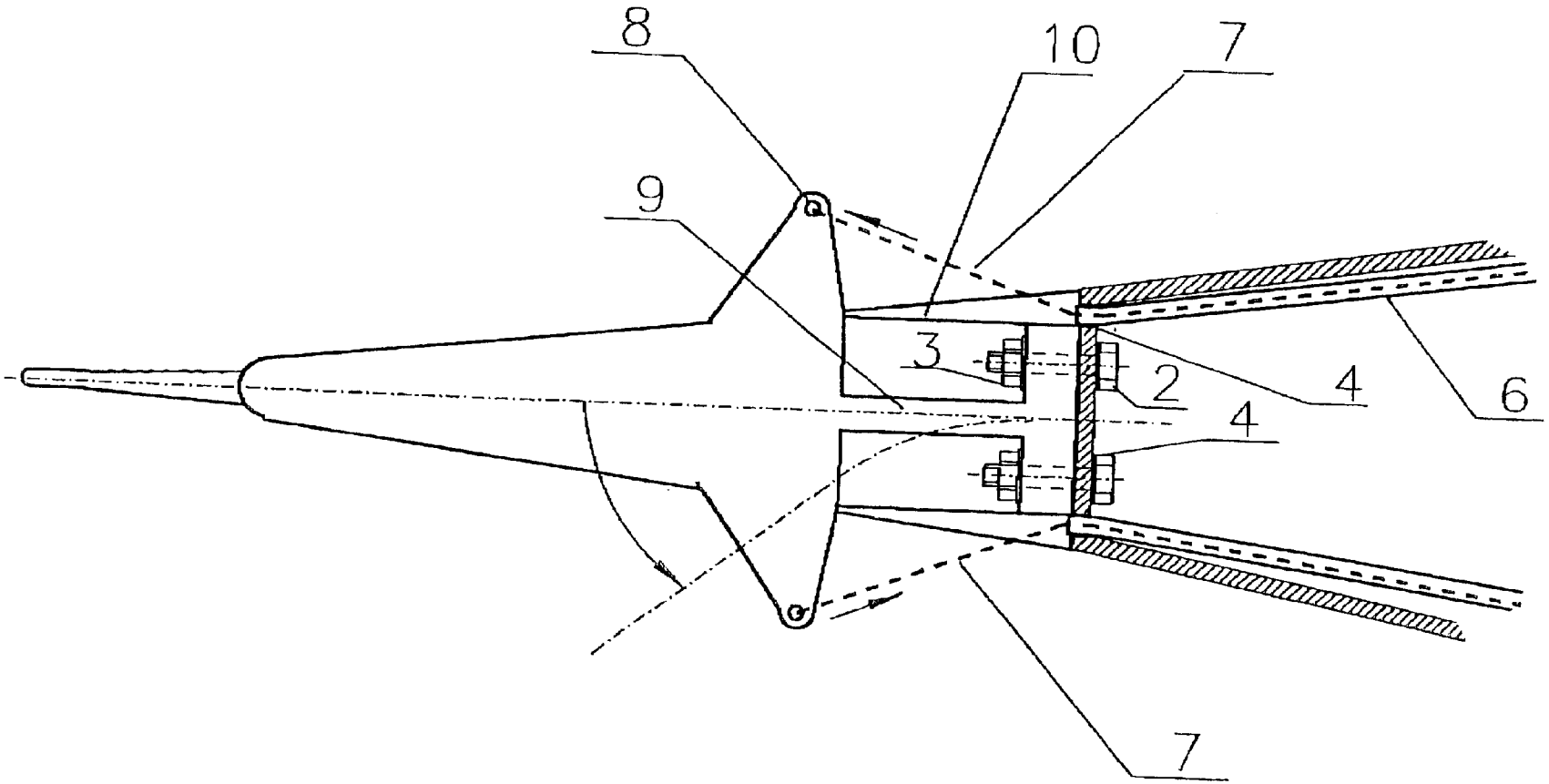
FIG. 2 shows a top view of the rudder construction.
Figure 3B:
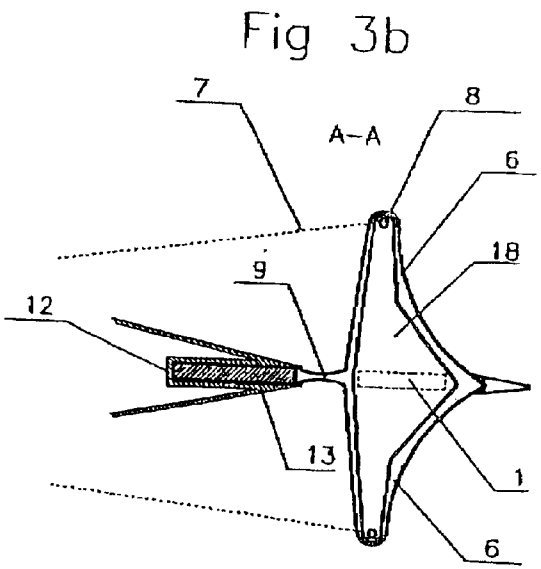
FIG. 3*b* shows a cross-section A—A of FIG. 3*a;*
Figure 3A:
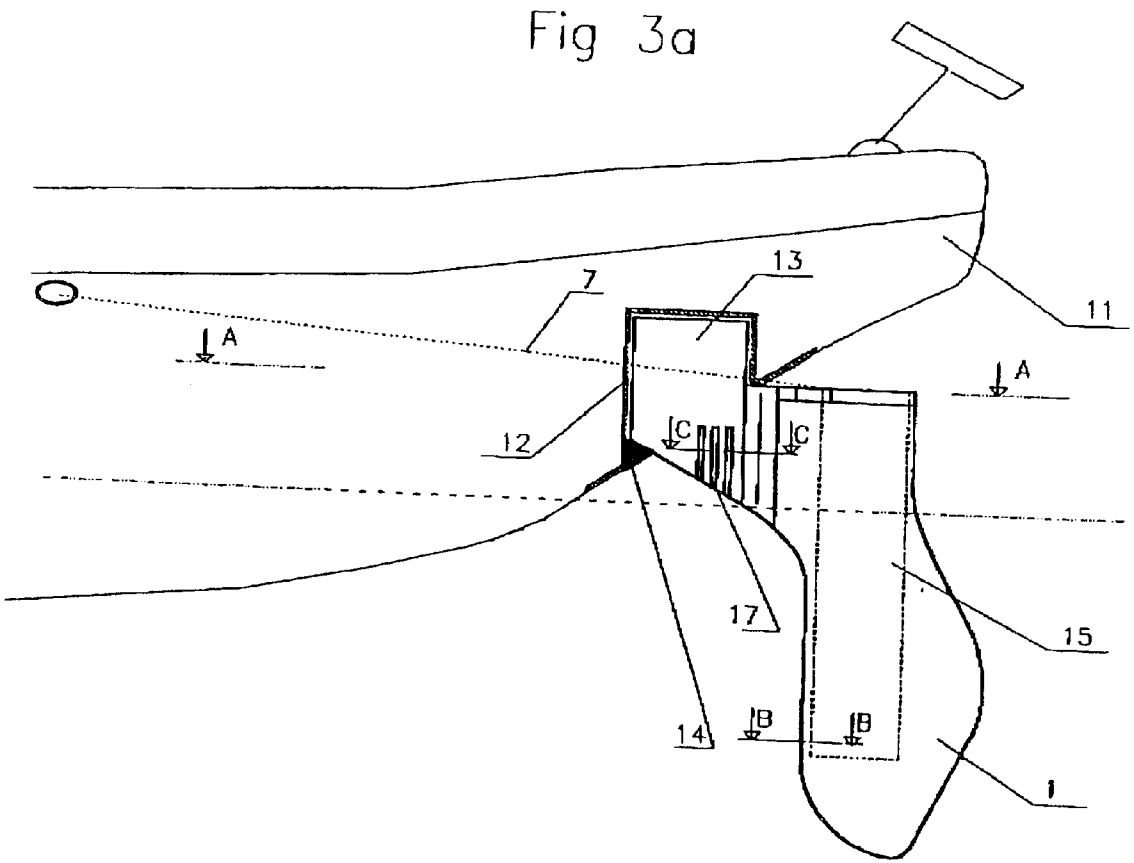
FIG. 3*a* shows a side view of a second embodiment of the rudder according to the invention.
Figure 4:
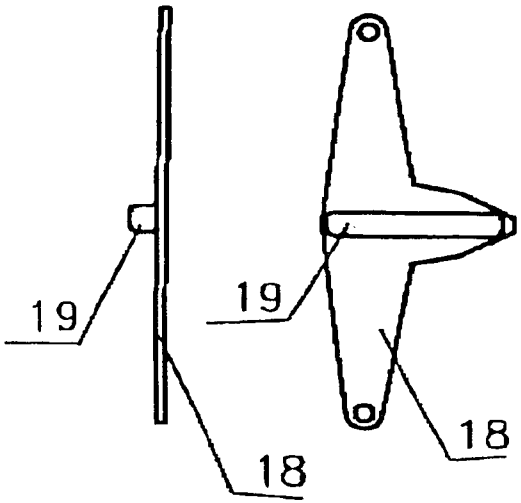
FIG. 4 shows a suitable device for turning the rudder of FIG. 3*a*.
Figure 3C:
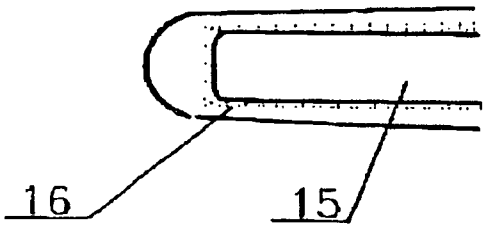
FIG. 3*c* shows a cross-section B—B of FIG. 3*a;*
Figure 3D:
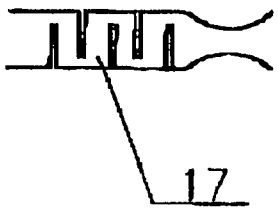
FIG. 3*d* show a cross-section C—C of FIG. 3*a*.

There are two alternative versions of the invention, the first of which is shown in FIGS. 1 and 2, the second version being illustrated in FIGS. 3*a*–3*d*, and 4. However, both versions depict one and the same basic construction, with some adaptations.

In the first version, shown in FIGS. 1 and 2, the rudder is attached in such a way that it lies under the vessel, forming part of the vessel's hull 11. The rudder 1 operates by being attached by bolts 2 and low nuts 3 to the vessel's hull. The bolts are attached to the vessel's hull during manufacture. They are locked with a sealing compound 4, or else the through-holes in the hull are made watertight in some other way. The bolts are long enough for the rudder to be attached to them and for it to be locked with nuts 3 and base plates 5. The base plates are specially made for this rudder, in such a way that they also apply pressure to the lower part of the rudder.

Sleeve tubes 6 are led through the hull, and the steering cables 7, for turning the rudder, are threaded through them. The sleeve tube 6 is attached to the hull, for example, using sealing compound. The steering cables 7, which can be of a material other than conventional cord, or can be of some type other than cables, are attached to holes 8 in the rudder. When a steering cable 7 is pulled, the rudder bends in the direction of the arrow, because a thinned zone 9 is arranged close to its attachment point. So that the said thinned section will not disturb flow, spoilers 10 are made in the rudder, which direct the water in a laminar flow over the thinned section 9. The main part of the rudder 1 is shaped as an essentially flat plate, making it suitable for use in steering. A flexible zone 17, which in this case is, for example, a thinned zone, is made in the rudder blade, to permit lateral bending. This flexible zone is intended to allow the lower part of the rudder blade to bend sideways if it strikes an obstacle, on, for example, the ground. All in all, such bends will return fully to their previous shape, if the force acting on them is removed.

In a second version, which is shown in the remainder of the figures, the rudder 1 is attached to the hull 11 of the vessel at its stem. In this case, during manufacture, a slot 12 is arranged in the hull of the vessel, into which a lug 13 in the rudder fits. Such an attachment may not necessarily require any separate attachment means, such as bolts. The rudder cannot be detached by a force acting forwards or backwards. It is prevented from dropping downwards by, for example, glue 14.

The steering cables 7 pull on lateral extensions 6 to the rudder, turning the device. A thinned zone 9 is arranged in the rudder and acts as a hinge, permitting turning.

In this embodiment, a flexible zone 17 is arranged in the construction, permitting bending. The flexible zone, which is shown in greater detail in FIG. 3*d*, can be shaped in many different ways. One way that can be contemplated, is to use a construction like that shown in FIG. 3*d*, which can perhaps be termed an accordion-like model. In any event, the construction permits a certain amount of bending in any direction whatever. Because the material is elastic, the rudder will return to its previous position after a collision.

To ensure that the rudder blade will not weigh too much, there is a core in the mould, which makes a cavity 15 in the rudder blade 1. If necessary, the blade can be made stiffer by placing glass-fibre fabric 16 (FIG. 3*c*), which remains in the construction, around the core. To prevent the cavity filling with water, a torsion plate 18 is installed, which plugs the cavity 15 and simultaneously transmits the cable force to the blade. There are suitable means, such as holes 8, at the ends of the torsion plate 18, to attach the steering cables 7.

In the torsion plate 18, there is a thickening or protrusion 19, shaped like the cavity, which penetrates the cavity 15 for about 20 mm. The torsion plate is made from, for instance, ABS plastic by injection moulding. The torsion plate 18 is secured to the rudder 1, for example, with glue, such as a sealing compound made from polyurethane, or in some other watertight manner.

As has been clearly shown above, the construction according to the invention has indisputable advantages. The use of the construction disclosed above achieves an essentially unbreakable rudder construction, with properties that are, however, very suitable for the purpose and which fulfills its task, i.e. the use of a simple embodiment will provide excellent steerability.

As stated above, the rudder construction according to the invention does not transmit sharp impacts to the hull of the vessel, but instead absorbs the impact energy and saves the vessel's hull from damage. The rudder construction according to the invention is also quite cheap to manufacture and is very suitable for manufacture in series production.

What is claimed is:

1. A rudder construction for use in light vessels, comprising: an elastomeric rudder blade having a longitudinal aspect and being attached to the hull of the vessel, wherein the rudder construction is attached permanently to the hull of the vessel and is equipped with a thinned zone to permit a main part of the rudder blade to turn relative to the longitudinal aspect, as well as at least one flexible zone to create flexibility in at least part of the rudder construction, in a collision, and to permit the at least part of the rudder to bend laterally to a side.

2. A construction according to claim 1, wherein the rudder blade includes a cavity.

3. A construction according to claim 1 wherein the elastomeric rudder is constructed of polyurethane.

4. A construction according to claim 1, wherein the flexible section is formed of an essentially folded construction that permits the rudder blade to flex both laterally and forwards and backwards.

5. A construction according to claim 1, wherein the rudder construction includes a protrusion extending to the side, in which there are means for attaching steering cables.

6. A construction according to claim 5, wherein the portion of the rudder construction including the protrusion is a separate component attached to the rudder construction.

7. A construction according to claim 5, wherein the portion of the rudder construction including the protrusion is an integral part of the rudder construction.

8. A rudder construction for use in light vessels, comprising: a rudder blade attached to the hull of the vessel, wherein the rudder construction is attached permanently to the hull of the vessel and is equipped with a thinned zone to permit a main part of the rudder blade to turn, as well as at least one flexible zone to create flexibility in at least part of the rudder construction, in a collision, the flexible zone being formed of an essentially folded construction that permits the rudder blade to flex both laterally and forwards and backwards.

* * * * *